US005427564A

United States Patent [19]

Whittington et al.

[11] Patent Number: 5,427,564

[45] Date of Patent: * Jun. 27, 1995

[54] CONTROLLED SURFACE TREATING WORK DEVICE

[75] Inventors: Glenn A. Whittington, Lino Lakes; Steven J. Austin, Minneapolis, both of Minn.

[73] Assignee: Robotics and Automation Corp., Fridley, Minn.

[ * ] Notice: The portion of the term of this patent subsequent to Dec. 28, 2010 has been disclaimed.

[21] Appl. No.: 100,318

[22] Filed: Aug. 2, 1993

[51] Int. Cl.[6] ..... B24B 49/08; B24B 49/16

[52] U.S. Cl. ..... 451/21; 241/37

[58] Field of Search ..... 51/165.9, 165.87, 165.77, 51/165.92, 50 H; 241/37

[56] References Cited

U.S. PATENT DOCUMENTS

| | | | |
|---|---|---|---|
| 3,877,180 | 4/1975 | Brecker | 51/165.9 |
| 4,566,426 | 1/1986 | Schleich et al. | 51/165.9 X |
| 5,272,842 | 12/1993 | Whittington et al. | 51/165.9 |

*Primary Examiner*—Joseph M. Gorski

*Attorney, Agent, or Firm*—Leo Gregory

[57] ABSTRACT

Relates to the automatic operation and control of a surface treating device having a powered tool and a work wheel for engagement with a work piece, said device being carried on a robotic arm and being adapted to maintain a uniform pressure of engagement of said work wheel with a work piece and a uniform rate of speed of the working surface of said work wheel in its engagement with the work piece, and a balancing pressure applied to said powered tool and work wheel to in effect make them weightless for their precise control.

16 Claims, 4 Drawing Sheets

CONTROLLED SURFACE TREATING WORK DEVICE

BACKGROUND OF THE INVENTION

1. Field of Invention

Relates to the automated application of a robot carried work device embodying speed and pressure control of a work wheel in treating the surface of a work piece.

2. Description of the Prior Art

The effort of finishing material surfaces such as of metal, glass and wood and the like has been traditionally the result of skilled hand labor. The skill has been applied not only in direct hand labor as in the use of hand tools but also in the hand control of mechanized tools. A uniformity of result has been difficult to achieve.

There were adverse effects to hand labor and the hand manipulation of tools resulting from the repetitive action of the effort which required the worker to operate in a dust laden atmosphere potentially damaging to the eyes and respiratory system of the worker. Also the repetitive action resulted in many workers developing and becoming afflicted with the Carpal Tunnel Syndrome which is a very undesirable affliction.

SUMMARY OF THE INVENTION

It is a principal object herein to make the work effort involved more productive and to provide a more desirable environment for the workers involved.

It is another object herein to make automatic and self regulating the work effort involved in the operation of a surface treatment device.

It is a further object herein to provide uniform results in the work effort output by the automatic self regulation of the work effort in treating the surface of a work piece.

It is a further object herein to have a predetermined control of and a regulated work effort in the application of the speed and pressure of a work wheel in its engagement with the surface of a work piece.

It is also an object herein to have the work device mounted as upon a robotic arm for a self controlled automated application of work effort.

These and other objects and advantages of the invention will be set forth in the following description made in connection with the accompanying drawings in which like reference characters refer to similar parts throughout the several views.

DESCRIPTION OF A PREFERRED EMBODIMENT

As a preliminary explanation in connection with the device of the invention herein, in the embodiment here presented, this device is particularly adapted to be mounted or based upon a robotic arm and the work pieces are brought to it for engagement with it by another automated work piece handling device such as another robotic arm which however does not form any part of the invention herein.

A work piece is brought into engagement with the device of the invention herein for deburring, sanding and/or polishing to produce a finished surface. A work piece is indicated at A and its robotic holding arm is indicated at B as in FIGS. 1 and 2.

Figure 1:
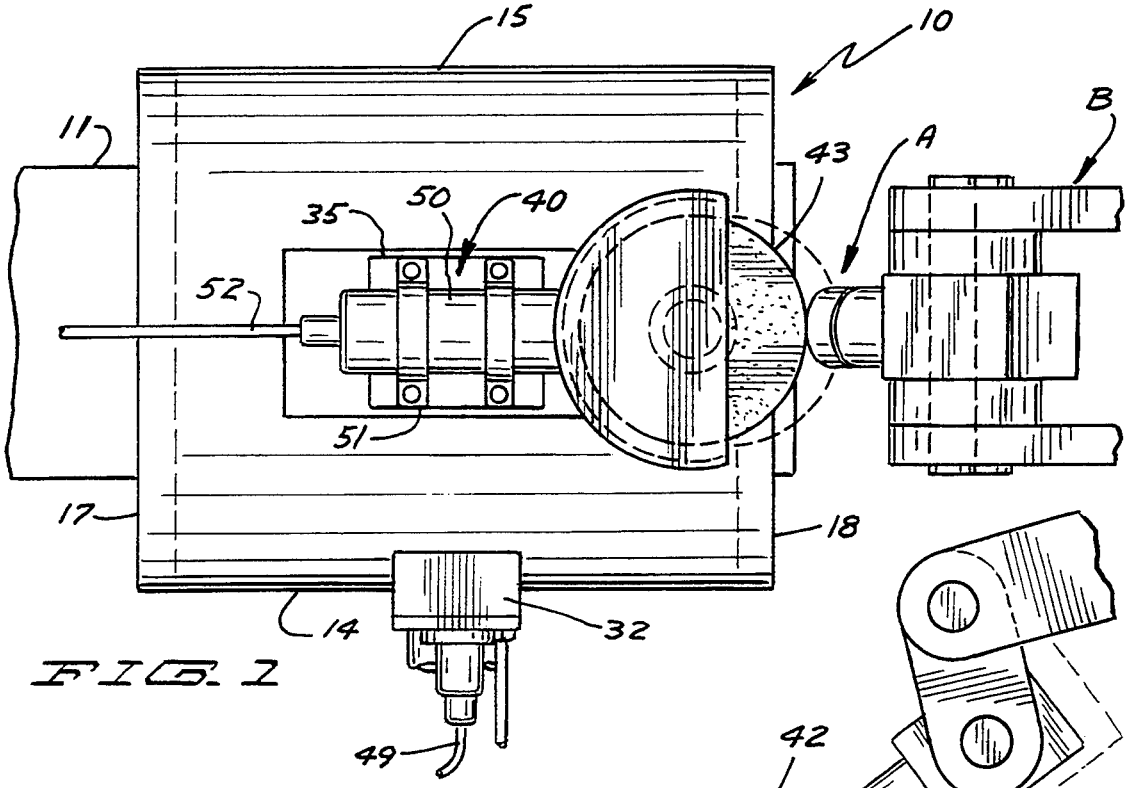
FIG. 1 is a top plan view with a portion thereof broken away and a portion in dotted line showing an alternate position.
Figure 2:
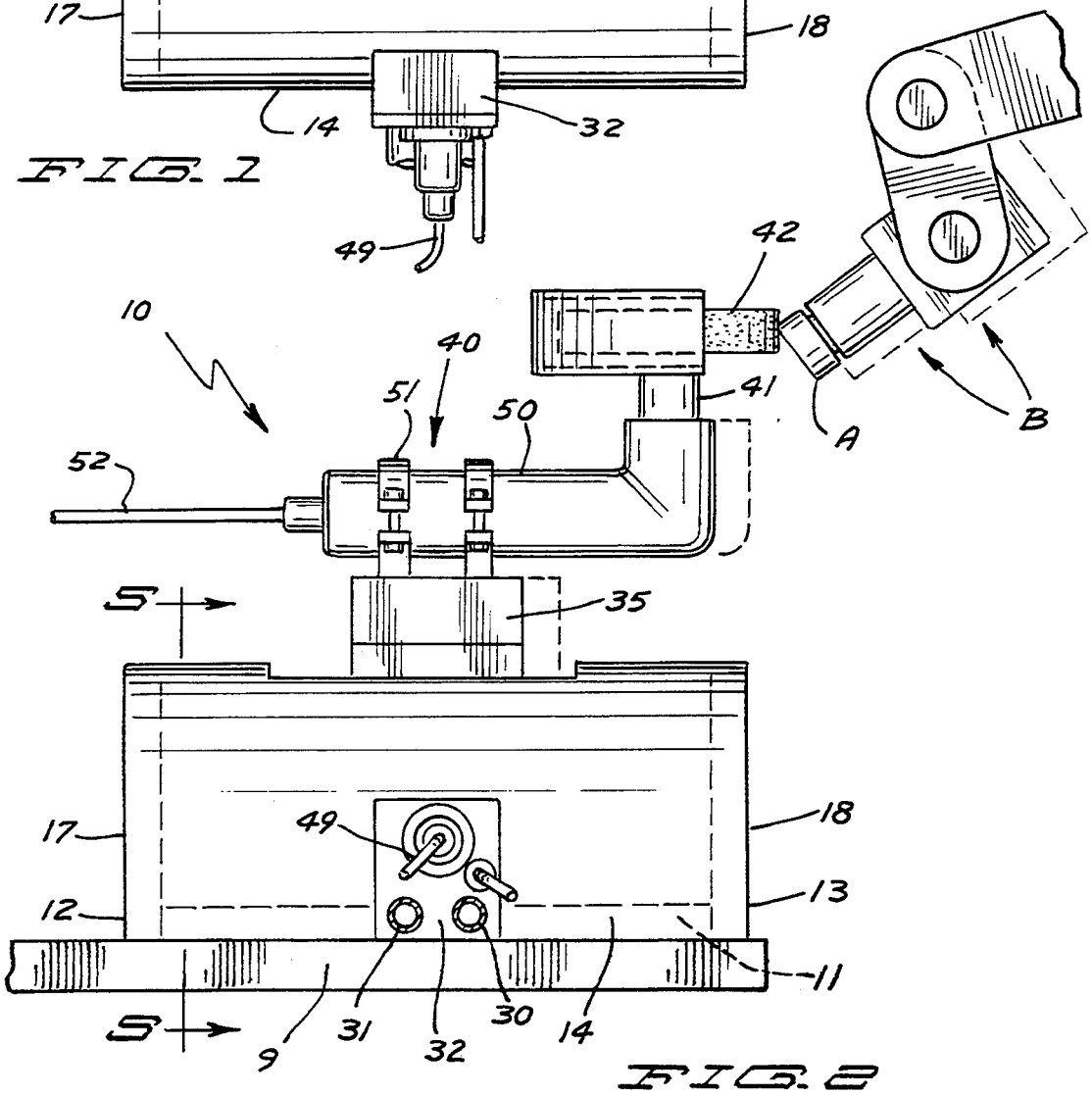
FIG. 2 is a view similar to FIG. 1 in side elevation.

Referring further now to FIGS. 1 and 2, the device of the invention herein is indicated generally by the reference numeral 10 and it is generally characterized as a surface treating device.

Figure 5:
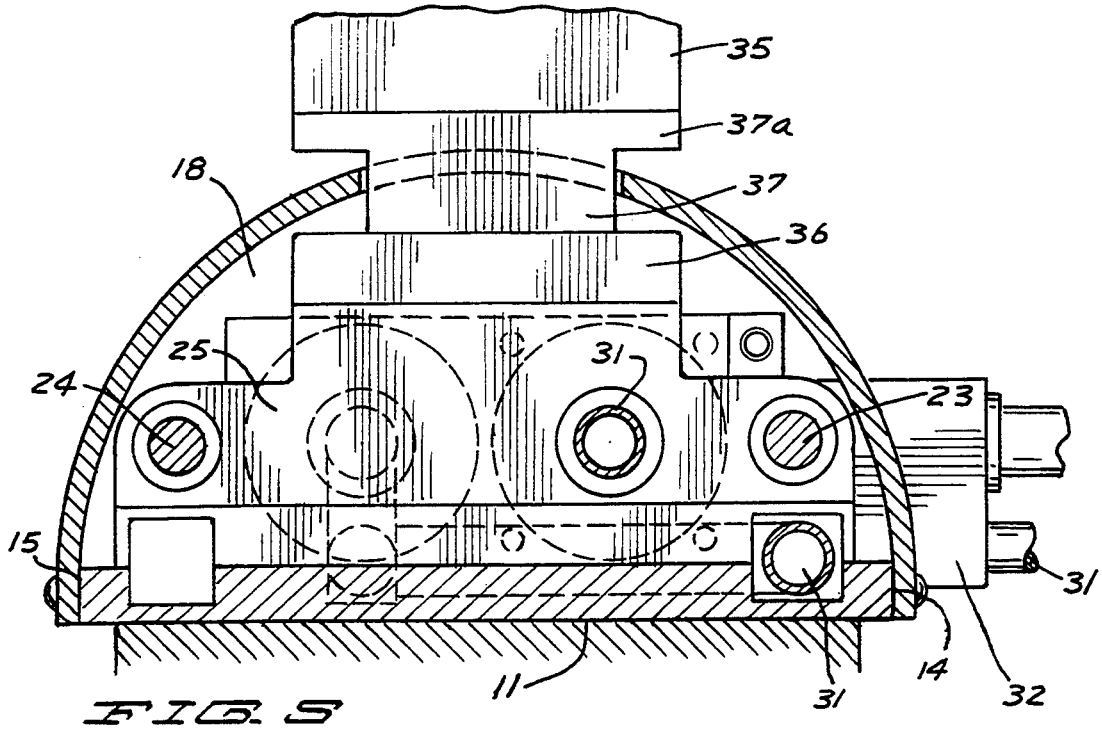
FIG. 5 is a view in vertical section taken on line 5—5 of FIG. 2 as indicated.

As shown, said device 10 has a bottom wall or base 11 which is generally rectangular in plan. Said base has ends 12 and 13 and sides 14 and 15, upstanding from said ends are end walls 17 and 18 which are arcuate or semicircular in form as shown in FIG. 5.

Figure 3:
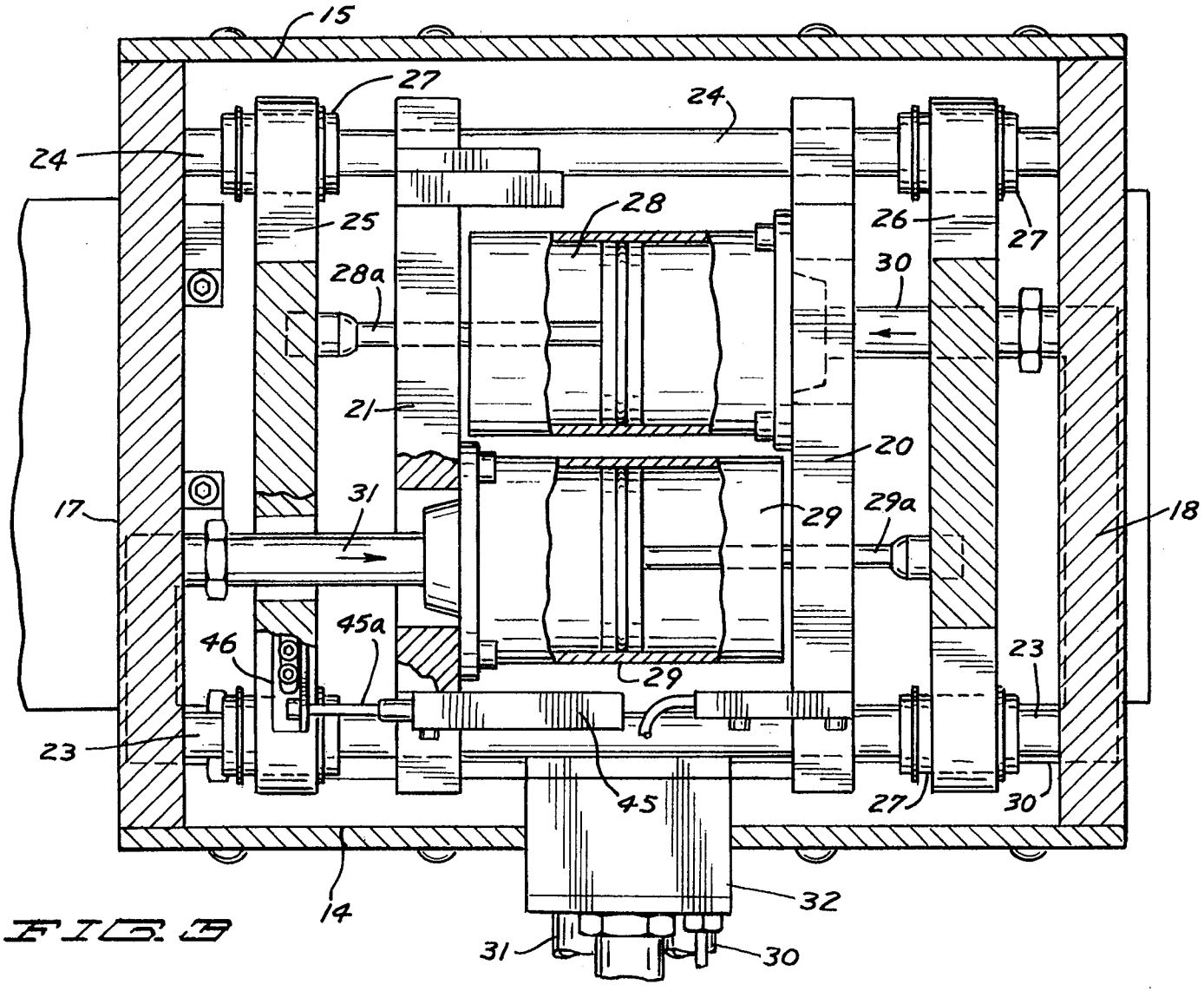
FIG. 3 is a view in horizontal section taken on line 3—3 of FIG. 4 as indicated.
Figure 4:
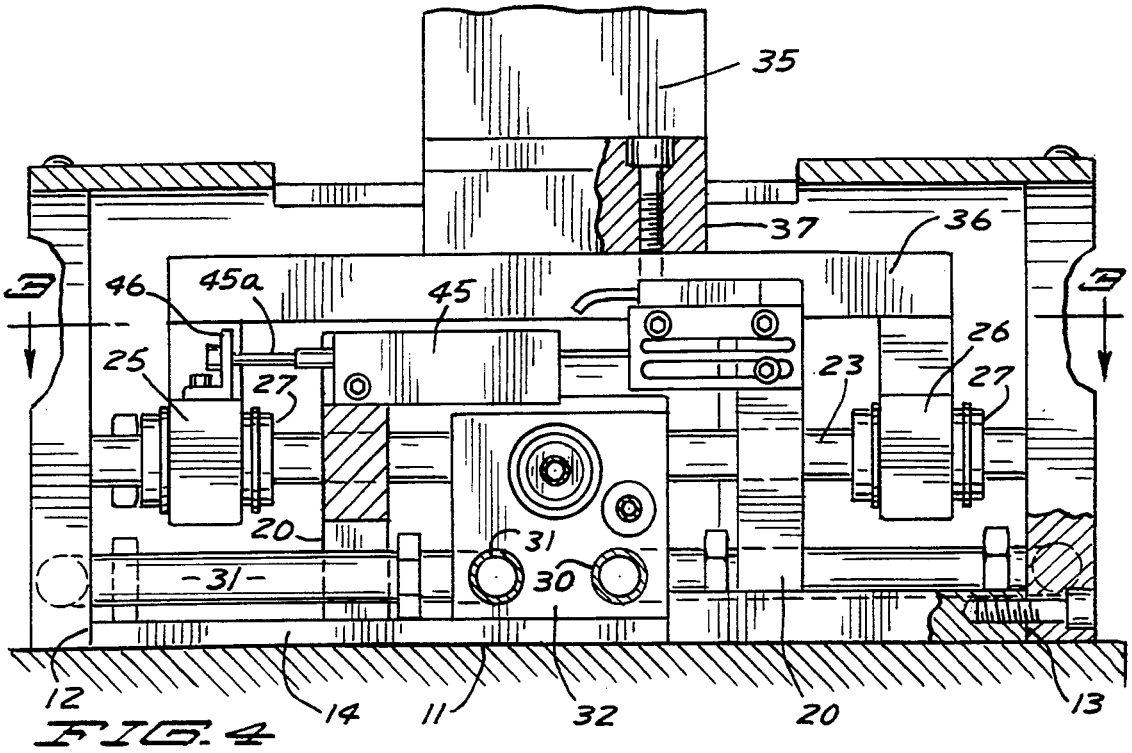
FIG. 4 is a longitudinal vertical section with a portion thereof broken away.

Referring to FIGS. 3 and 4, upstanding from said base are spaced transverse support members 20 and 21, which are equally spaced from said end walls.

Extending through said support members adjacent the ends thereof and extending to said end walls of said base are slide rods 23 and 24, said slide rods being in parallel spaced relation.

Mounted respectively onto said slide rods between said support members and said end walls are slide members 25 and 26. Said slide members are indicated as being rectangular in plan and are vertically disposed. Said slide members are mounted onto said slide rods on low friction bearings 27 whereby there results unrestricted free sliding movement between said slide members and said rods.

Positioned between said support members (FIG. 3) are a pair of reversely disposed pneumatic cylinders or tanks 28 and 29 respectively having extending pistons **28*a* and 29*a***.

Leading into said pneumatic cylinders 28 and 29 are air lines 30 and 31 (FIGS. 4 and 5), said air lines being in communication with a source of pressurized air through a computer regulated air pressure control member 32, said computer is not herein shown.

Said cylinder 28 has a piston **28*a* in connective engagement with the slide member 25 and said cylinder 29 has its piston 29*a* in connective engagement with the slide member 26**.

Mounted onto said slide members 25 and 26 is a tool supporting member 35 (FIGS. 4 and 5) having a base plate 36 mounted directly onto said slide members and having a supporting portion **37*a* underlying said tool support member 35**.

Mounted onto said tool support member 35 is a powered tool indicated generally by the reference 40, said tool comprising a body member 50 secured to said mounting member 35 by conventional brackets or clamps 51. Extending from said body member 50 is a power line 52 which will be extended -to a convenient power source. Said tool member may be self-powered.

With particular reference to FIGS. 1 and 2, said tool body member 50 carries a grinding or work wheel 42 mounted upon a vertical drive shaft 41 and having a peripheral or surface portion 43 adapted to debut, grind or sand a surface or be adapted to put a polished finish onto a surface. Thus the axis of said work wheel is at right angles to the plane of said tool supporting plate 35 and moves longitudinally therewith as viewed in FIGS. 1 and 2 and its axis is also right angles to the movement of the slide members 25 and 26.

An essential novel element of this device is said air pressure control unit 32 which is adapted and caused to have said pistons of said cylinders 28 and 29 exert an equal force to have a constant pressure apply on said work wheel to have said work wheel apply a constant uniform pressure on an engaged work piece in treating the surface of such work piece. The cylinders and their respective pistons are positioned to move said slide members, the tool support member mounted thereon and the tool mounted work wheel a predetermined distance in the direction of the axis of said pistons which is at right angles to the axis of the work wheel.

With the direction of the movement of said tool supporting member being at right angles to the axis of the work wheel and with the edge or peripheral surface of the work wheel being engaged with said work piece A, it is seen that the pistons of said cylinders 28 and 29 can be preset to cause the tool supporting member to move a specified distance and be thus positioned.

The constant use of the work wheel will cause its edge or peripheral surface to wear and eventually reduce the diameter of the work wheel. As the work wheel diameter is reduced, the peripheral speed of the work wheel will reduce. However for a certain degree wear, any difference in the finish of the work piece will be imperceptible. Thus a leeway is built into the work wheel. At the point at which the leeway allowance is used up, as will be described, a conventional signal not here shown will alert the operator to reindex or replace the work wheel.

In addition to a control on the pressure applied by the work wheel onto an engaged work piece, there is also a control maintained on the peripheral speed of the work wheel. In the present embodiment, for this purpose, a linear potentiometer 45 is used as indicated in FIG. 3. Said potentiometer has a rod or shaft extension 45*a* which serves as a sensing shaft and the same is secured to one of the sliding members, which in the present instance is member 25, being secured thereto by a bracket 46. The potentiometer will be adjusted to provide for the predetermined rate of speed of the work wheel based on the extent of movement of said slide member to which it is attached.

As the periphery of the work wheel wears from use up to its leeway allowance, with each increment of additional increased extension of its sensing shaft in moving with said sliding member, the potentiometer immediately accelerates the motor of the powered tool by providing a proportional voltage signal for the powered tool to maintain the original peripheral speed of the work wheel. This is a conventional arrangement not specifically shown here.

With the inclusion of the two pneumatic cylinders 28 and 29, their respective pistons 28*a* and 29*a* exert a precise balancing or counterbalancing pressure between the powered tool and its work wheel to offset the influence of the unbalance of weight of the powered tool 40 as to its work wheel 42 as mounted upon the support member 35 whereby with the powered tool and its work wheel being in balance with each other and thus kept in balance, in effect, it is as if the powered tool and its work wheel are weightless as to each other. Thus a very precise pressure may be applied in the engagement of a work piece by the work wheel, the pressure being adapted exactly for the result it is desired to achieve.

Any disturbance in the balance established is sensed by the pressure control member 32 and immediate adjustment is made through said cylinders and its pistons acting on said sliding members to maintain the desired balance of the mounted or supported tool 40 and its work wheel.

Figure 6:
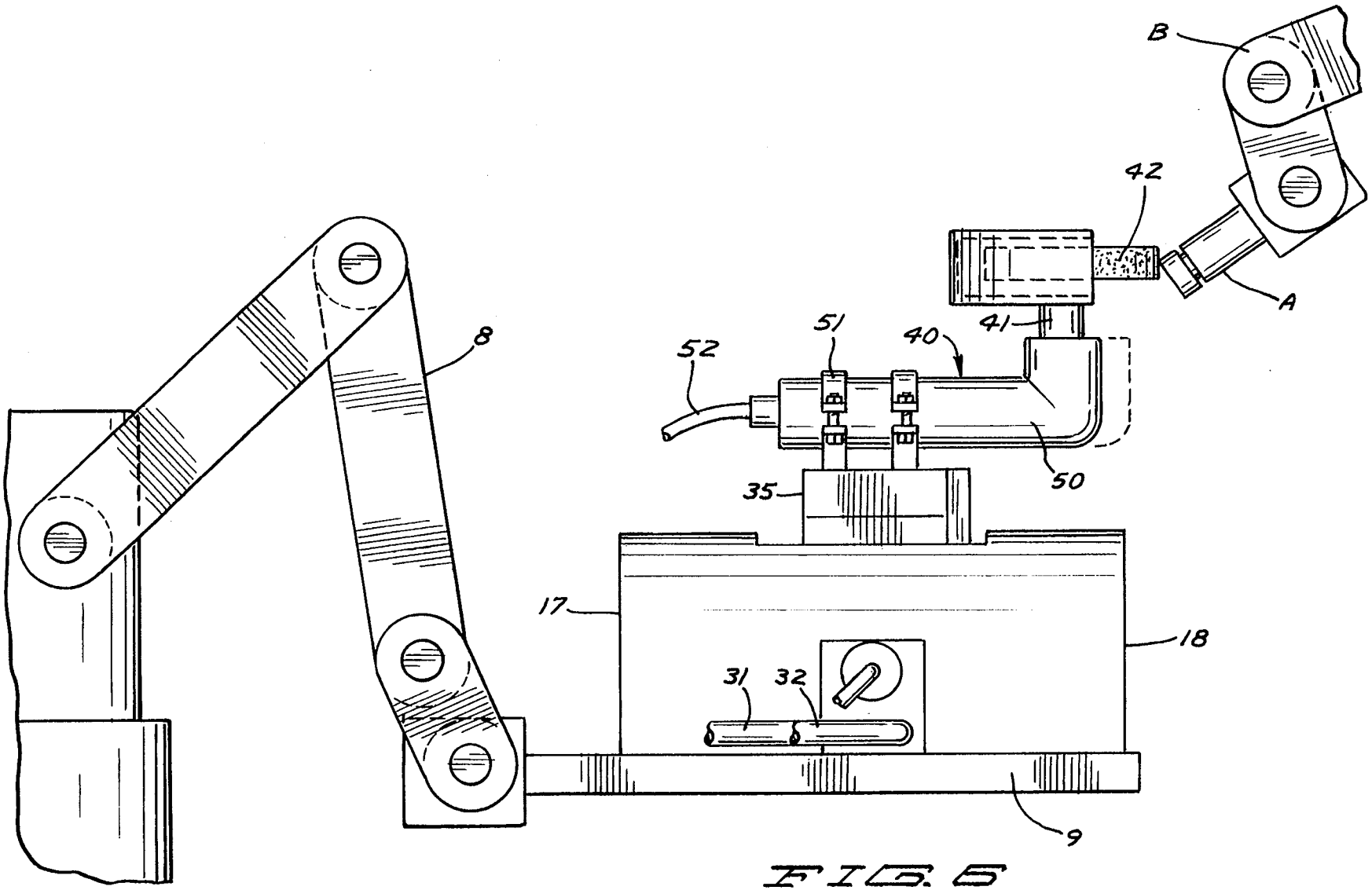
FIG. 6 is a broken view in side elevation showing the device herein mounted onto an arm extension as of a robot.

Referring to FIG. 6, the entire device 10 upon its mounting plate 9 is shown carried by a robot operated arm extension 8, the robot being no part of the invention herein is not further shown.

It will of course be understood that various changes may be made in the form, details, arrangement and proportions of the device of the invention without departing from the scope of the invention, which, generally stated, consists in an apparatus capable of carrying out the objects above set forth, such as disclosed and defined in the claims.

What is claimed is:

1. A mobile regulated work piece surface treatment device, having in combination a housing having a pair of end walls, supporting members disposed in said housing spaced from said end walls, a pair of slide members supported by said supporting members respectively disposed between said supporting members and said end walls, a pair of pneumatic cylinders disposed within said housing, a piston from each of said cylinders respectively attached to each of said slide members, a line of pressurized air to each of said cylinders, means carried by said device regulating the pressure of air in said air lines, a tool mounting plate carried by said slide members, a powdered tool and work wheel supported on said tool mounting plate, said air lines actuating said pistons to move in opposite directions applying controlled air pressure against each slide member to neutralize the effect of the weight of said power tool and work wheel by counter-balancing the same, one of said pistons causing a movement of said slide members to move said tool mounting plate and work wheel thereon a predetermined distance to a work piece contact point, and said one of said pistons as actuated by one of said air lines providing additional pressure for a determined pressure to be applied by said work wheel in its engagement with a work piece.

2. The structure of claim 1, wherein a robot arm supports said housing.

3. The structure of claim 1, wherein said supporting members comprise a pair of upstanding supports extending transversely of said housing, a pair of transversely spaced slide rods carried by said supports and extending between said end walls, and said slide members being mounted onto said slide rods.

4. The structure of claim 1, wherein the axis of said work wheel is at right angles to the direction of movement of said slide members.

5. The structure of claim 1, wherein said pistons sense a change in the extent to which said work wheel is extended by a change in the extent of movement of said slide members provide a signal to the operator to change the work wheel.

6. The structure of claim 1, including a work wheel speed control sensing means having an extendable shaft attached to a slide member, said means sensing an increase in the length of movement of said slide member, said increase resulting from a wearing away of the work piece engaging surface of said work wheel resulting in a reduction of the peripheral rate of rotation of said wheel, and said means having connection with said power tool to increase the rate of rotation of said wheel to maintain a constant peripheral speed.

7. The structure of claim 6, including means regulating the peripheral edge surface speed of said work wheel, said work wheel in wearing away its work piece engaging surface causes a reduction in the surface speed of rotation by itself, said regulating means sensing the change in extent of movement of said slide members by connection with said power tool causes said tool to accelerate the rate of rotation of said work wheel to maintain a constant speed of rotation of said work engaging surface of said work wheel.

8. A regulated work piece surface treatment device, having in combination a housing having a pair of end walls, supporting means within said housing spaced from said end walls, a pair of transversely spaced slide rods carried by said supporting means extending between end walls, a pair of slide members respectively mounted onto said slide rods between said support means and said end walls, a tool mounting plate carried by said slide members, a pair of pneumatic cylinders disposed reversely of one another within said housing, a piston extending from each of said cylinders to each of said slide members, a pressurized air line from an appropriate air source to each of said cylinders actuating the pistons in said cylinders to move in opposite directions, means carried by said housing regulating the pressure in said air lines, one of said pistons being adapted to move one of said slide members to extend said work wheel to a predetermined contact point under a predetermined air line pressure for engagement with a work piece, and said slide members are caused by wear of said work wheel to move beyond said predetermined extent for engagement with said work piece.

9. The structure of claim 7, wherein said supporting means comprise a pair of spaced walls, said slide rods extending through said walls, and said slide members being substantially rectangular in plan having a height above that of said supporting means.

10. A regulated work piece surface treatment device, having in combination a housing supported by a robotic arm, said housing having end walls, a pair of spaced support members in said housing transversely thereof and respectively spaced from said end walls thereof, a pair of pneumatic cylinders disposed between said support members positioned reversely of each other, a pressurized air line to each of said cylinders from an appropriate source of air, adjustable means carried by said housing regulating the pressure of air in said air lines, a pair of transversely spaced guide rods extending through said support members to said end walls, a pair of slide members respectively mounted onto said slide rods between said support members and said end walls, a tool mounting plate carried on said slide members, a powered tool equipped with a work wheel on said mounting plate, said pistons being respectively attached to said slide members, and said air lines respectively actuating said pistons to move in opposite directions to apply such pressure to said slide members as to neutralize the weight effect between said tool and its work wheel and a predetermined additional pressure is applied by the piston moving by said tool mounting plate and said work wheel thereon into working position by movement of said slide members and said work wheel being moved a predetermined extent to a contact point for engagement with a work piece.

11. The structure of claim 10, wherein said work wheel is positioned to have its axis at right angles to the direction of movement of said slide members.

12. The structure of claim 10, wherein a pressurized air line from said air source sweeping across said housing to divert dust created by the surface treatment action of said work wheel.

13. A regulated surface treatment device, having in combination a housing having a pair of end walls, a pair of spaced support members in said housing transversely thereof respectively spaced from said end walls, a pair of transversely spaced guide rods carried by said support members longitudinally of said housing, a pair of slide members respectively mounted onto said guide rods between said support members and said end walls, a pair of pneumatic cylinders between said support members reversely positioned relative to each other, an air line to each cylinder from a pressurized air source, a piston from each of said cylinders respectively attached to each of said slide members, a tool mounting plate carried by said slide members, a powered tool carried on said plate having a work piece engaging work wheel, said pistons actuated by said air lines to move in opposite directions to bear a balancing pressure against said slide members to neutralize the effect of the weight of said powered tool and work wheel by counter-balancing the same, one of said pistons actuated by the pressure of its air line to provide additional pressure to one of said slide members to cause said powered tool and its work wheel to become extended a predetermined extent to a predetermined contact point for engagement by a work piece, and said additional pressure to noe of said slide members being a predetermined pressure to be applied by said work wheel in treating the surface of said work piece engaged therewith.

14. The structure of claim 13, wherein a predetermined leeway allowance is provided with said additional pressure to accommodate the wearing off of said surface of said work wheel whereby any difference in the resulting treatment of the surface of said work piece by said work wheel are imperceptible.

15. The structure of claim 13, including said pistons detect from engagement with said slide members a change in the extent of movement beyond said predetermined extent and a leeway allowance in addition thereto, thereby indicating a signal to indicate a need to change said work wheel or reindex the same.

16. The structure of claim 13, including a work wheel speed control means, an extensible shaft from said control means attached to a slider member, said means sensing an increase in the extent of movement of said slide member beyond a predetermined amount, said increase in movement being caused by a wearing away of the surface of said work wheel engaging work piece, said wearing away resulting in a reduction of the diameter of said work wheel which in turn results in a reduction of the peripheral speed of said work wheel, and said means having connection with said powered tool causing it to increase the rotation speed of said work wheel to maintain a constant peripheral speed of said work wheel.

* * * * *